United States Patent [19]

Abraham

[11] Patent Number: 4,697,856

[45] Date of Patent: Oct. 6, 1987

[54] PORTABLE CABINET FOR DISPENSING MEDICATION

[76] Inventor: Aleyamma Abraham, 277 Washington St., Carteret, N.J. 07008

[21] Appl. No.: 605,151

[22] Filed: Apr. 30, 1984

[51] Int. Cl.[4] ..... A47B 49/00

[52] U.S. Cl. ..... 312/305; 211/163; 211/194; 312/125; 312/135; 312/209; 312/267

[58] Field of Search ..... 312/11, 97.1, 125, 135, 312/209, 266, 267, 305; 211/163, 194, 131, 129, 144

[56] References Cited

U.S. PATENT DOCUMENTS

| | | | |
|---|---|---|---|
| 444,216 | 1/1891 | Bodenhamer | 312/305 X |
| 470,022 | 3/1892 | Tuthill | 312/305 X |
| 657,463 | 9/1900 | Simpson | 312/209 |
| 2,207,472 | 7/1940 | Young | 312/135 X |
| 2,217,810 | 10/1940 | Pape | 312/305 |
| 2,347,985 | 5/1944 | Beersman | 312/305 X |
| 2,882,114 | 4/1959 | Sease et al. | 312/305 X |
| 3,198,338 | 8/1965 | McCormick | 211/131 X |
| 3,378,134 | 4/1968 | Wilkinson et al. | 312/97.1 |
| 3,426,913 | 2/1969 | Abatiell, Jr. | 211/194 |
| 3,627,122 | 12/1971 | Garbe, Jr. | 312/209 X |

FOREIGN PATENT DOCUMENTS

| | | | |
|---|---|---|---|
| 122679 | 11/1946 | Australia | 312/305 |
| 803415 | 4/1951 | Fed. Rep. of Germany | 211/144 |
| 151891 | 11/1981 | Fed. Rep. of Germany | 211/163 |
| 345155 | 11/1904 | France | 211/163 |
| 645373 | 9/1962 | Italy | 312/305 |
| 234997 | 6/1925 | United Kingdom | 211/163 |

*Primary Examiner*—Kenneth J. Dorner
*Assistant Examiner*—Thomas A. Rendos
*Attorney, Agent, or Firm*—Ezra Sutton

[57] ABSTRACT

The present invention relates generally to a portable cabinet for dispensing medication and more particularly, to a medication dispenser in which a plurality of different medication dosages are contained in separate compartments with the dispenser being properly marked to indicate which dosages are to be given to which patients and the times at which they are to be given. The apparatus includes a portable cabinet having a plurality of vertically arranged and spaced apart trays disposed within the cabinet, with each of the trays including a plurality of compartments for receiving the medication dosages. The trays are individually rotatably mounted within the cabinet.

3 Claims, 6 Drawing Figures

PORTABLE CABINET FOR DISPENSING MEDICATION

The present invention relates generally to a portable cabinet for dispensing medication and more particularly, to a medication dispenser in which a plurality of different medication dosages are contained in separate compartments with the dispenser being properly marked to indicate which dosages are to be given to which patients and the times at which they are to be given.

BACKGROUND OF THE INVENTION

In the past, the practice for dispensing dosages of medication, such as in hospitals, has caused certain difficulties. For example, a plurality of dosages of medication are typically placed in separate containers and when a patient is required to take a plurality of medications during the course of a day, the patient receives a plurality of the containers, each of which contains a plurality of dosages. For example, a patient may be required to take several medications during the course of a day, with one medication being required once a day, a second medication twice a day and a third medication three times a day. If one multiplies the number of patients on such a program at a hospital, the difficulties of providing the necessary medication to each patient at the proper time during the course of each day becomes an enormous job.

Broadly, it is an object of the present invention to provide an improved system for dispensing medications. Specifically, it is within the contemplation of the present invention to provide an improved system, which is simple and inexpensive and easy to use, and greatly enhances the accuracy and reliability of providing proper medications to each of a large number of patients at the proper time during the course of a day.

It is a further object of the present invention to provide a system for dispensing medications which is tamper proof and provides the necessary security in hospitals that is required for the drugs being dispensed.

SUMMARY OF THE INVENTION

Briefly, in accordance with the principle of the present invention, there is provided an improved medication dispensing system, which includes a portable cabinet having a plurality of vertically arranged and spaced apart trays disposed within the cabinet, with each of the trays including a plurality of compartments for receiving patient medication dosages. The trays are individually rotatably mounted within the cabinet for rotational movement relative to a plurality of vertically arranged openings and doors formed within the cabinet. More particularly, each of the cabinet openings and doors is in alignment with one of the vertically arranged trays, so as to provide access through said cabinet opening to a respective one of the trays, so that each tray can be rotated to the desired compartment to obtain the required medication dosage from the compartment selected.

Advantageously, as a result of the present invention, there is provided an improved medication dispensing system, which is easy and inexpensive to use, which is accurate and reliable, and which provides the necessary security for hospitals and the like. More particularly, at different intervals during the course of a day, and typically this would be at six different times during the day, the person in charge of dispensing medication will select the particular tray for that time of day. Within that tray, there are a plurality of compartments, with each compartment being assigned to a particular patient with appropriate patient indicia means on the front wall of the compartment which is visible through the access door of the cabinet. The person dispensing the medication can then rotate the tray to the various compartments to dispense the necessary medication dosages contained within each compartment for each patient. In this manner, it is a rather simple task at the beginning of each day to refill each compartment in each tray with the necessary medication dosages for each patient. Then it is a rather simple matter during the course of the day to select and dispense the medication dosages for each patient at the proper intervals during the course of the day.

BRIEF DESCRIPTION OF THE DRAWINGS

Further objects, features and advantages of the present invention will become apparent upon the consideration of the detailed description of the presently preferred embodiments taken in conjunction with the accompanying drawings, wherein.

DETAILED DESCRIPTION OF THE PREFERRED EMBODIMENT

Figure 1:
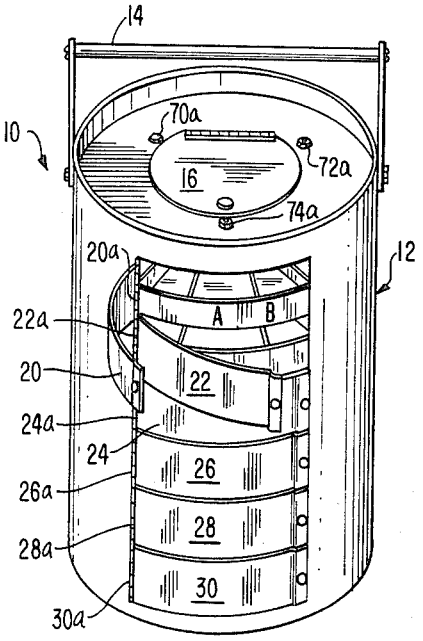
FIG. 1 is a front perspective view of a portable cabinet for dispensing medication embodying the principles of the present invention.
Figure 2:
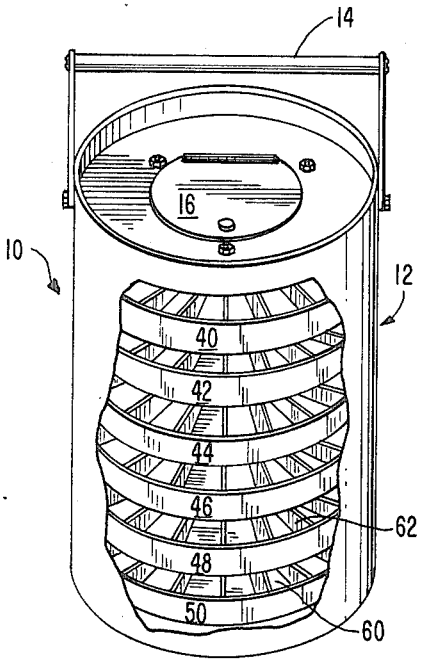
FIG. 2 is a perspective view similar to FIG. 1 having a front portion of the cabinet wall broken away, in order to view the plurality of vertically arranged trays contained within the cabinet.
Figure 3:
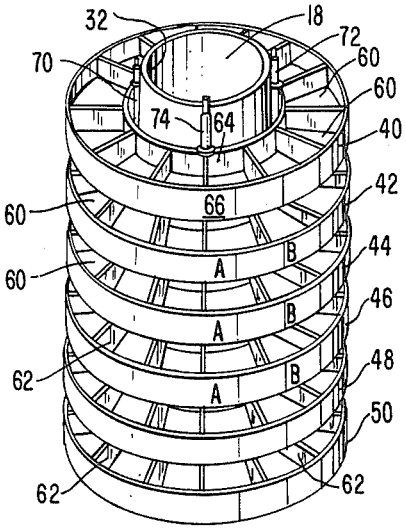
FIG. 3 is a perspective view of the plurality of vertically arranged trays removed from the portable cabinet.

Referring now to FIG. 1, there is illustrated an embodiment of the present invention 10, which includes a circular cabinet 12, made of any suitable light-weight material, such as metal, aluminum or the like. The cabinet 12 includes a handle 14 to make the cabinet easily portable and transportable. In addition, the cabinet 12 includes a top door 16 for access to a storage compartment 18 shown more clearly in FIG. 3. The cabinet 12 includes a plurality of vertically arranged doors 20, 22, 24, 26, 28 and 30, with each of the doors mounted on respective hinges 20*a*, 22*a*, 24*a*, 26*a*, 28*a* and 30*a*. As shown in FIG. 3, disposed within the cabinet 12 is a vertically arranged hollow column 32, in which is formed the storage compartment 18, with the access door 16 providing a cover for the hollow column 32.

Disposed about the column 32 are a plurality of dispensing trays 40, 42, 44, 46, 48 and 50, which are circular in shape, with each tray including a plurality of identical compartments 60 formed by a plurality of dividers 62. In addition, each of the respective trays has an inner circular wall 64 and an outer circular wall 66. As will be noted, in the preferred embodiment, there are six trays 40 to 50 and six access doors 20 to 30. As will be explained more fully herein, medication dosages are typically dispensed every four hours during the course of a twenty-four hour day, so that six trays are typically suitable for dispensing medication at the various intervals during the course of the day. Of course, it should be understood that more or less trays can be utilized in accordance with the principles of the present invention. For example, eight trays may be utilized for dispensing medication at three hour intervals during the course of a twenty-four hour day. In addition, on the front wall 66 of each tray, appropriate indicia means are provided, so that each compartment is labeled with the name or other indicia of an individual patient. For example, as shown in FIG. 3, tray 42 includes a plurality of compartments 60, each having the indicia A, B, C, etc., each of said letters representing a patient's name. Alternatively, the patient's name can actually be provided on the outer circular wall 66 of each of the trays.

To mount the plurality of trays for rotational movement about column 32, there are a plurality of vertically disposed rods. In the preferred embodiment, there are three vertical rods 70, 72 and 74, each being attached at the top of the cabinet at 70*a*, 72*a* and 74*a* and at the bottom of the cabinet (not shown).

Figure 4:
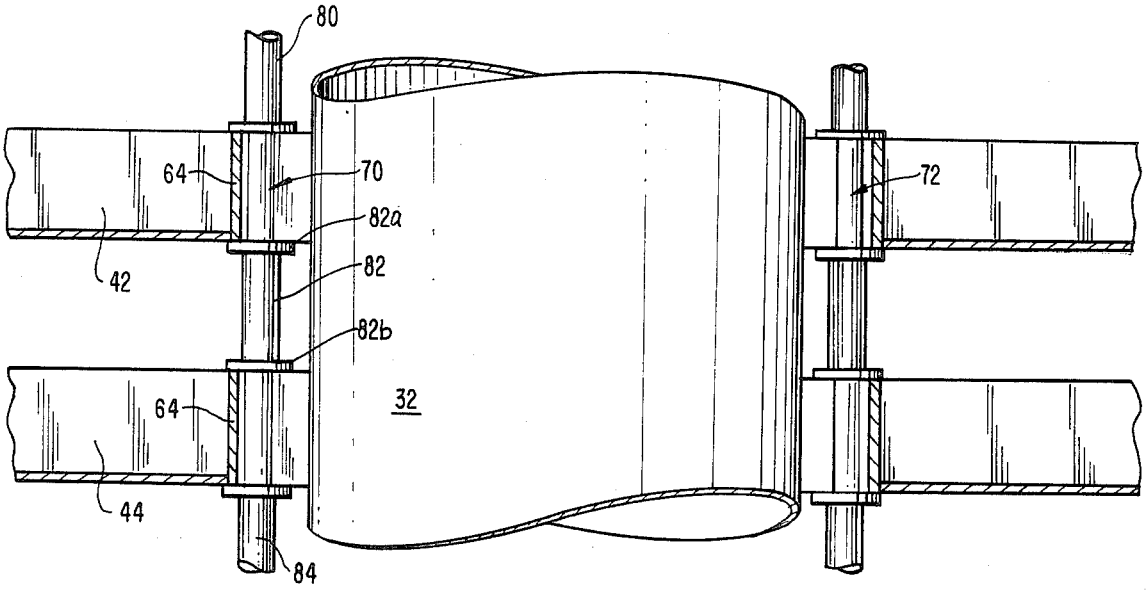
FIG. 4 is an elevational view, partly in section, showing the arrangement for mounting the trays within the cabinet.

Turning to FIG. 4, there is shown in detail the arrangement for rotatably mounting the trays relative to the vertical column 32 and the cabinet 12. As each of the rods 70, 72 and 74 and the elements mounted thereon are identical, only rod 70 need be discussed in detail. As shown in FIG. 4, rod 70 has a plurality of spacer elements mounted thereon between each tray, which spacer elements are rotatably disposed on the rod 70. In FIG. 4, there are shown spacer elements 80, 82 and 84 between trays 42 and 44. Each of the spacer elements are identical, and as shown, spacer element 82 includes disks 82*a* and 82*b*, which disks are provided for rotatably engaging the adjacent trays 42, 44, respectively. In addition, the spacer elements separate the trays by the desired distance for access to the compartments within each tray. As shown in FIG. 4, the inner circular wall 64 of each tray is disposed between the respective disks 82*a*, 82*b*. As the spacer elements are rotatably disposed on the rod 70, the trays 42, 44 can be rotated with the spacer elements relative to the rods 70, 72 and 74, as well as relative to the central column 32 and the cabinet 12. In this manner, when a particular door is opened, such as door 20 or 22, access may be had to tray 40 or 42, and the particular tray may be rotated to a particular compartment to dispense therefrom the medication for a particular patient. Within each compartment, there will have been placed the necessary medication dosages for that particular patient for that time of day. As a result, the present invention provides an easy and inexpensive system to accurately and reliably dispense medication dosages for a plurality of patients at each interval during the course of the day.

Figure 5:
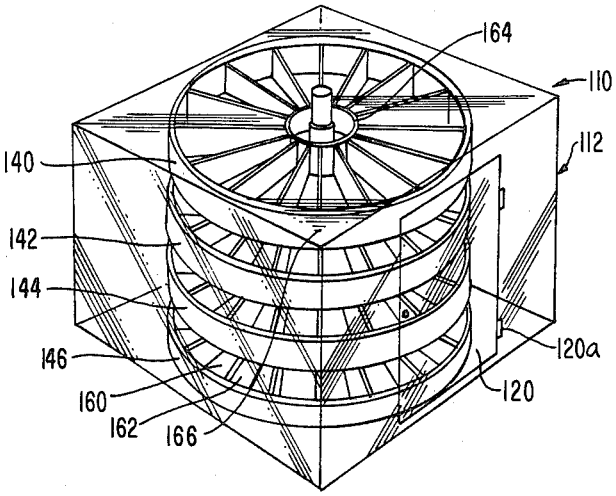
FIG. 5 is a perspective view illustrating another embodiment of the present invention embodying the principles of the present invention.
Figure 6:
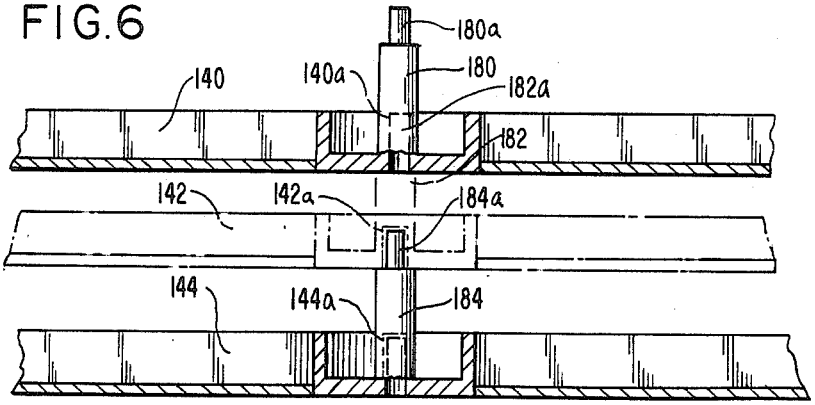
FIG. 6 is an elevational view, partly in section, showing the arrangement of mounting the trays of the embodiment shown in FIG. 5.

Turning now to FIGS. 5 and 6, another embodiment of the present inventioon is illustrated, which has been designated by the reference numeral 110. As shown, in this embodiment, there is a cabinet 112 having a door 120 mounted on hinges 120*a*. Disposed within the cabinet are a plurality of vertically arranged trays 140, 142, 144 and 146, with each of the trays having identical compartments 160 formed by dividers 162. In addition, each of the trays includes an inner circular wall 164 and an outer circular wall 166. In addition, as described above, the outer circular wall can be provided with suitable indicia indicating the patient's identification or patient's name for each of the respective compartments for each tray.

Referring to FIG. 6, the apparatus for rotatably mounting each of the trays is illustrated. The trays 140, 142 and 144 are provided with respective spacer elements 180, 182 and 184, and each of these spacer elements include a shaft insert 180*a*, 182*a* and 184*a*. In addition, each of the trays has an opening formed in the bottom thereof designated by reference numerals 140*a*, 142*a*, 144*a*, respectively. In assembling the apparatus, shaft insert 182*a* of spacer element 182 is inserted within tray opening 140*a*, and this occurs between each of the respective trays to vertically arrange them as shown in FIG. 5. In this manner, each of the trays can be individually rotated relative to the cabinet 112, and by opening the cabinet door 120, access can be had to any of the compartments 160 of each tray by simply rotating each tray relative to the cabinet 112.

In view of the foregoing, it will be noted that there has been provided an advantageous system and apparatus in accordance with the present invention, wherein one or more dosages of medication can be dispensed to a plurality of patients at each given time interval during the course of the day. For example, the uppermost tray in each cabinet can be used for dispensing medication at 9:00 AM each day. If each tray contains thirty-two compartments, then up to thirty-two patients can be supplied their medication dosages from the medication dispenser of the present invention. Further, in each compartment, for each patient there can be more than one medication dosage for that patient at 9:00 AM. Also, a different number of medications for that same patient can be contained in the next lower tray, which can be used to dispense dosages at the next four-hour interval, such as at 1:00 PM.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A portable cabinet for dispensing medication to patients comprising:

a plurality of vertically arranged and spaced-apart trays disposed within said cabinet, with each of the trays being circular in shape and used at a different interval during the day;

each of said trays including a plurality of compartments formed by divider means disposed within each of said trays; said compartments for receiving medication for said patients;

a vertically arranged stationary column formed within the center of said cabinet, the interior of said column forming a storage compartment, said cabinet including an opening for access to said storage compartment;

a plurality of vertically arranged rods for individually rotatably mounting said trays relative to said stationary column so that each of said trays is capable of independent rotational movement relative to said column and cabinet, each of said rods including support means thereon for supporting said trays relative to said cabinet;

said support means including spacer elements disposed on said rods, said spacer elements including disks at either end thereof to rotatably engage said trays and to space said trays apart for rotational movement relative to said rods and said cabinet;

said cabinet having a plurality of vertically arranged access openings for access to each of said trays;

indicia means associated with each of said compartments for indicating a particular patient; and each of said cabinet openings being in alignment with one of said trays to provide access through said cabinet opening to one of said trays to rotate said tray to a selected compartment determined by said indicia means for obtaining one or more medications from the selected compartment associated with a particular patient.

2. A cabinet in accordance with claim 1, wherein said plurality of rods are connected at their upper and lower ends to said cabinet, so that said trays are capable of rotating relative to said rods and said cabinet.

3. A cabinet in accordance with claim 1, wherein said cabinet includes handle means for transporting said cabinet.

* * * * *